US010137450B2

(12) United States Patent
Lay et al.

(10) Patent No.: US 10,137,450 B2
(45) Date of Patent: Nov. 27, 2018

(54) MICROFLUIDICS CARTRIDGE WITH PIPETTING GUIDE

(71) Applicant: Tecan Trading AG, Männedorf (CH)

(72) Inventors: Tiffany Lay, San Jose, CA (US); Daniel Hoffmeyer, San Jose, CA (US); Anne R. Kopf-Sill, Portola Valley, CA (US)

(73) Assignee: TECAN TRADING AG, Mannedorf (CH)

( * ) Notice: Subject to any disclaimer, the term of this patent is extended or adjusted under 35 U.S.C. 154(b) by 1002 days.

(21) Appl. No.: 14/335,027

(22) Filed: Jul. 18, 2014

(65) Prior Publication Data

US 2016/0016170 A1 Jan. 21, 2016

(51) Int. Cl.
*B01L 3/00* (2006.01)
*B01L 3/02* (2006.01)

(52) U.S. Cl.
CPC ..... *B01L 3/502792* (2013.01); *B01L 3/50273* (2013.01); *B01L 3/0275* (2013.01); *B01L 2200/027* (2013.01); *B01L 2300/0816* (2013.01); *B01L 2300/161* (2013.01); *B01L 2400/0427* (2013.01)

(58) Field of Classification Search
None
See application file for complete search history.

(56) References Cited

U.S. PATENT DOCUMENTS 5,486,337 A 1/1996 Ohkawa
6,565,727 B1 5/2003 Shenderov
7,597,854 B1 * 10/2009 Reynolds ..... B01L 9/50 422/511

(Continued)

FOREIGN PATENT DOCUMENTS

WO 2006125767 A1 11/2006
WO 2008106678 A1 9/2008

(Continued)

OTHER PUBLICATIONS

International Preliminary Report on Patentability dated Jan. 24, 2017, with Written Opinion.

*Primary Examiner* — Eli S Mekhlin
(74) *Attorney, Agent, or Firm* — Notaro, Michalos & Zaccaria P.C.

(57) ABSTRACT

A disposable cartridge configured as a digital microfluidics system for manipulating samples in liquid portions having a cartridge accommodation site and a central control unit for controlling selection of individual electrodes of an electrode array located at the site and for providing plural electrodes with individual voltage pulses for manipulating liquid portions by electrowetting. The cartridge has a hydrophobic working surface and a rigid cover with a second hydrophobic surface, the hydrophobic surfaces facing each other and being separated in parallel planes by a gap. The cartridge has plural pipetting guides for safe entering/withdrawing liquids into/from the gap with a pipette tip. At least one of the pipetting guides provides an abutting surface sealingly admittable by a counter surface of a pipette tip, located at a pipetting orifice that reaches through the rigid cover, and configured to prevent a pipette tip from touching the hydrophobic working surface.

14 Claims, 3 Drawing Sheets

(56) References Cited

U.S. PATENT DOCUMENTS

Figure 1:
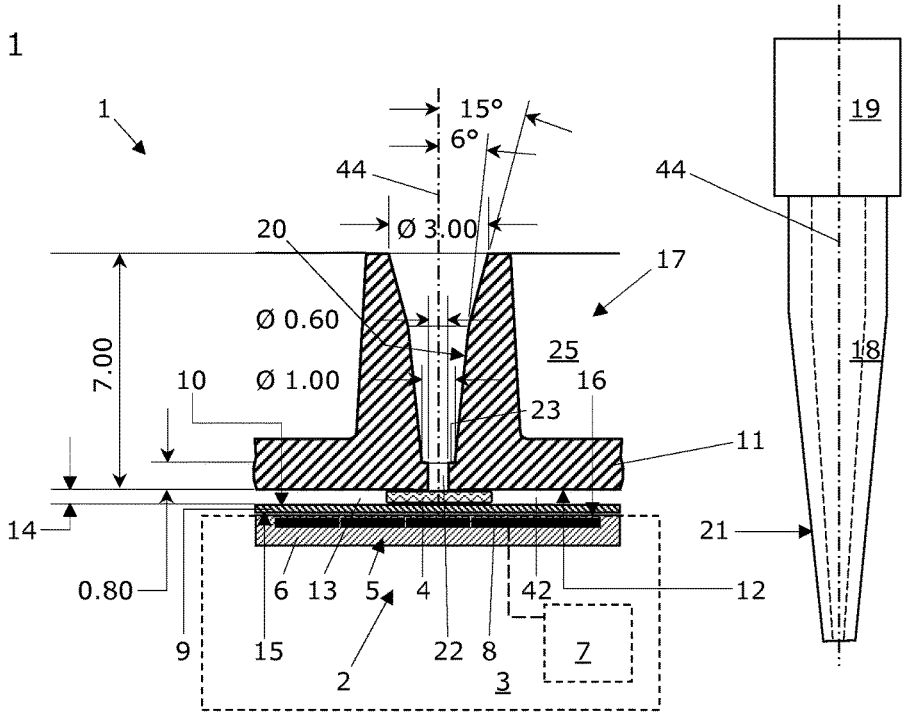

| | | | | |
|---|---|---|---|---|
| 2005/0277125 | A1* | 12/2005 | Benn | B01J 19/0046 435/6.11 |
| 2009/0298059 | A1 | 12/2009 | Gumbrecht et al. | |
| 2013/0134040 | A1* | 5/2013 | Lee | G01N 27/44791 204/451 |
| 2013/0270114 | A1 | 10/2013 | Feiglin | |
| 2014/0161686 | A1* | 6/2014 | Bort | B01L 3/502715 422/502 |

FOREIGN PATENT DOCUMENTS

| | | | |
|---|---|---|---|
| WO | 2010069977 | A1 | 6/2010 |
| WO | 2011002957 | A2 | 1/2011 |
| WO | 2014108366 | A1 | 7/2014 |

* cited by examiner

MICROFLUIDICS CARTRIDGE WITH PIPETTING GUIDE

FIELD OF TECHNOLOGY

The present invention relates a disposable cartridge for use in a digital microfluidics system for manipulating samples in liquid portions or droplets. Typically, such a digital microfluidics system comprises a cartridge accommodation site and a central control unit for controlling the selection of individual electrodes of an electrode array located at said cartridge accommodation site and for providing a number of said electrodes with individual voltage pulses for manipulating liquid portions or droplets by electrowetting. The disposable cartridge of the present invention comprises a hydrophobic working surface and a rigid cover with a second hydrophobic surface. These hydrophobic surfaces are facing each other and are separated or separable in essentially parallel planes by a gap with a defined gap height. The disposable cartridge of the present invention further comprises at least one pipetting guide.

This technical field generally relates to the control and manipulation of liquids in a small volume, usually in the micro- or nanoscale format. In digital microfluidics, a defined voltage is applied to electrodes of an electrode array, so that individual droplets are addressed (electrowetting). For a general overview of the electrowetting method, please see Washizu, IEEE Transactions on Industry Applications, Volume 34, No. 4, 1998, and Pollack et al., *Lab chip,* 2002, Volume 2, 96-101. Briefly, electrowetting refers to a method to move liquid droplets using arrays of microelectrodes, preferably covered by a hydrophobic layer. By applying a defined voltage to electrodes of the electrode array, a change of the surface tension of the liquid droplet, which is present on the addressed electrodes, is induced. This results in a remarkable change of the contact angle of the droplet on the addressed electrode, hence in a movement of the droplet. For such electrowetting procedures, two principle ways to arrange the electrodes are known: using one single surface with an electrode array for inducing the movement of droplets or adding a second surface that is opposite a similar electrode array and that provides at least one ground electrode. A major advantage of the electrowetting technology is that only a small volume of liquid is required, e.g. a single droplet. Thus, liquid processing can be carried out within considerably shorter time. Furthermore the control of the liquid movement can be completely under electronic control resulting in automated processing of samples.

RELATED PRIOR ART

Automated liquid handling systems are generally well known in the art. An example is the Freedom EVO® robotic workstation from the present applicant (Tecan Schweiz AG, Seestrasse 103, CH-8708 Männedorf, Switzerland). These automated systems are larger systems that are not designed to be portable and typically require larger volumes of liquids (microliter to milliliter) to process.

A device for liquid droplet manipulation by electrowetting using one single surface with an electrode array (a monoplanar arrangement of electrodes) is known from the U.S. Pat. No. 5,486,337. All electrodes are placed on a surface of a carrier substrate, lowered into the substrate, or covered by a non-wettable surface. A voltage source is connected to the electrodes. The droplet is moved by applying a voltage to subsequent electrodes, thus guiding the movement of the liquid droplet above the electrodes according to the sequence of voltage application to the electrodes.

An electrowetting device for microscale control of liquid droplet movements, using an electrode array with an opposing surface with at least one ground electrode is known from U.S. Pat. No. 6,565,727 (a biplanar arrangement of electrodes). Each surface of this device may comprise a plurality of electrodes. The two opposing arrays form a gap. The surfaces of the electrode arrays directed towards the gap are preferably covered by an electrically insulating, hydrophobic layer. The liquid droplet is positioned in the gap and moved within a non-polar filler fluid by consecutively applying a plurality of electric fields to a plurality of electrodes positioned on the opposite sites of the gap.

Containers with a polymer film for manipulating samples in liquid droplets thereon are known from WO 2010/069977 A1: A biological sample processing system comprises a container for large volume processing and a flat polymer film with a lower surface and a hydrophobic upper surface. The flat polymer film is kept at a distance to a base side of the container by protrusions. This distance defines at least one gap when the container is positioned on the film. A substrate supporting at least one electrode array is also disclosed as well as a control unit for the liquid droplet manipulation instrument. The container and the film are reversibly attached to the liquid droplet manipulation instrument. The system thus enables displacement of at least one liquid droplet from the at least one well through the channel of the container onto the hydrophobic upper surface of the flat polymer film and above the at least one electrode array. The liquid droplet manipulation instrument is accomplished to control a guided movement of said liquid droplet on the hydrophobic upper surface of the flat polymer film by electrowetting and to process there the biological sample.

The use of such an electrowetting device for manipulating liquid droplets in the context of the processing of biological samples is also known from the international patent application published as WO 2011/002957 A2. There, it is disclosed that a droplet actuator typically includes a bottom substrate with the control electrodes (electrowetting electrodes) insulated by a dielectric, a conductive top substrate, and a hydrophobic coating on the bottom and top substrates. The cartridge may include a ground electrode, which may be replaced by a hydrophobic layer, and an opening for loading samples into the gap of the cartridge. Interface material (e.g. a liquid, glue or grease) may provide adhesion of the cartridge to the electrode array.

Disposable cartridges for microfluidic processing and analysis in an automated system for carrying out molecular diagnostic analysis are disclosed in WO 2006/125767 A1 (see US 2009/0298059 A1 for an English translation). The cartridge is configured as a flat chamber device (with about the size of a check card) and can be inserted into the system. A sample can be pipetted into the cartridge through a port and into processing channels.

Droplet actuator structures are known from the international patent application WO 2008/106678. This document particularly refers to various wiring configurations for electrode arrays of droplet actuators, and additionally discloses a two-layered embodiment of such a droplet actuator which comprises a first substrate with a reference electrode array separated by a gap from a second substrate comprising control electrodes. The two substrates are arranged in parallel, thereby forming the gap. The height of the gap may be established by spacer. A hydrophobic coating is in each case disposed on the surfaces which face the gap. The first and second substrate may take the form of a cartridge, eventually comprising the electrode array.

From US 2013/0270114 A1, a digital microfluidics system for manipulating samples in liquid droplets within disposable cartridges is known. The disposable cartridge comprises a bottom layer, a top layer, and a gap between the bottom and top layers. The digital microfluidics system comprises a base unit with at least one cartridge accommodation site that is configured for taking up a disposable cartridge, at least one electrode array comprising a number of individual electrodes and being supported by a bottom substrate, and a central control unit for controlling selection of the individual electrodes of said at least one electrode array and for providing these electrodes with individual voltage pulses for manipulating liquid droplets within said cartridges by electrowetting.

OBJECTS AND SUMMARY OF THE PRESENT INVENTION

Typically, assays require previous storage or introduction of reagents in the working gap of disposable cartridge for electrowetting. In most cases, sample portions are to be introduced into the working gap for processing and/or analysis. Introduction or loading of reagents, buffers, sample portions—or in general liquids—into the working gap of a disposable cartridge is a common task for carrying out biological or biochemical assays in the working gap of disposable cartridge for electrowetting. However, such introduction very often needs special handling skills of the operating person that is equipped with widely used laboratory equipment such as a hand pipette with disposable pipette tips. Such handling skills are particularly necessary to overcome the problem of introducing a aqueous liquid into a narrow gap in the cartridge fitted with hydrophobic surfaces (see e.g. the user guide Mondrian™ SP Universal Cartridge of the company NUGEN Technologies, Inc. San Carlos, Calif. 9470 USA; part No. 8010). It is therefore an object of the present invention to suggest pipetting guides for disposable cartridges for electrowetting, i.e. pipetting guides that allow easy and riskless loading of liquids into the gap of a disposable cartridge. It is a further object of the present invention to suggest pipetting guides that allow subsequent loading of supplemental portions of liquids into the gap of a disposable cartridge. It is a further object of the present invention to suggest pipetting guides that allow easy and riskless un-loading of liquids from the gap of a disposable cartridge. It is a further object of the present invention to suggest pipetting guides that allow easy and riskless subsequent un-loading of portions of liquids from the gap of a disposable cartridge.

These objects are achieved in that it is proposed that the disposable cartridge introduced at the beginning further comprises a number of pipetting guides for safe entering and/or withdrawing liquids into and/or from the gap of the disposable cartridge with a tip of a pipette; at least one of the pipetting guides:

- being located at the rigid cover, and
- being configured to prevent a tip of a pipette from touching the hydrophobic working surface, and
- providing an abutting surface that is sealingly admittable by a counter surface of a tip of a pipette.

Additional and inventive features and preferred embodiments and variants of the pipetting guides for safe entering and/or withdrawing liquids into and/or from the gap of the disposable cartridge derive from the respective dependent claims.

Advantages of the present invention comprise:

- The pipetting guides protects the integrity of the cartridge and in particular of the working film, thus improving reliability of the working with this cartridge.
- The pipetting guides provide ease of use for loading into and un-loading liquids from the gap of the cartridge, such that even untrained persons are enabled to reliably carry out these operations.
- The pipetting guides allow automatization of pipetting using pipetting robots, whether the disposable cartridge is presented horizontally or tilted.

BRIEF INTRODUCTION OF THE DRAWINGS

Figure 2:
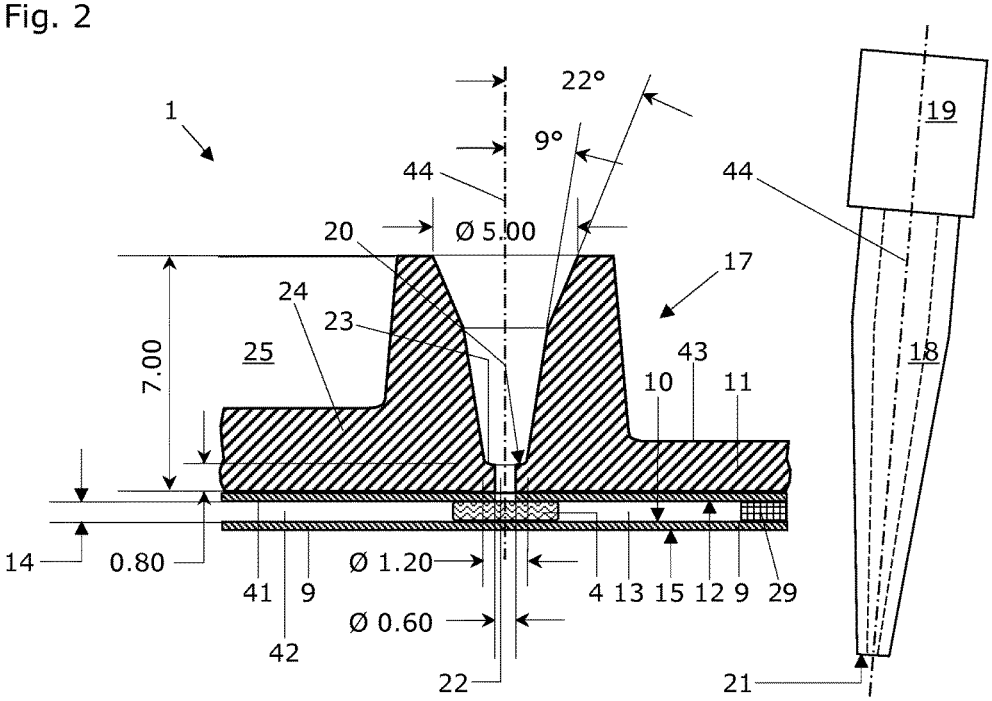
Figure 3:
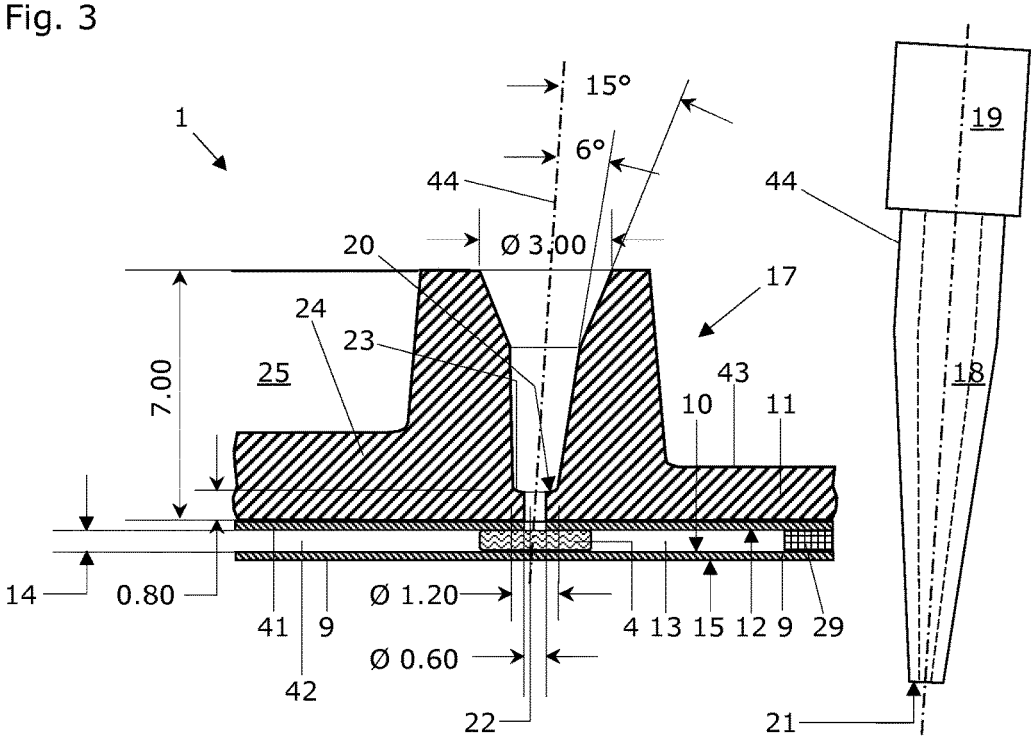
Figure 4:
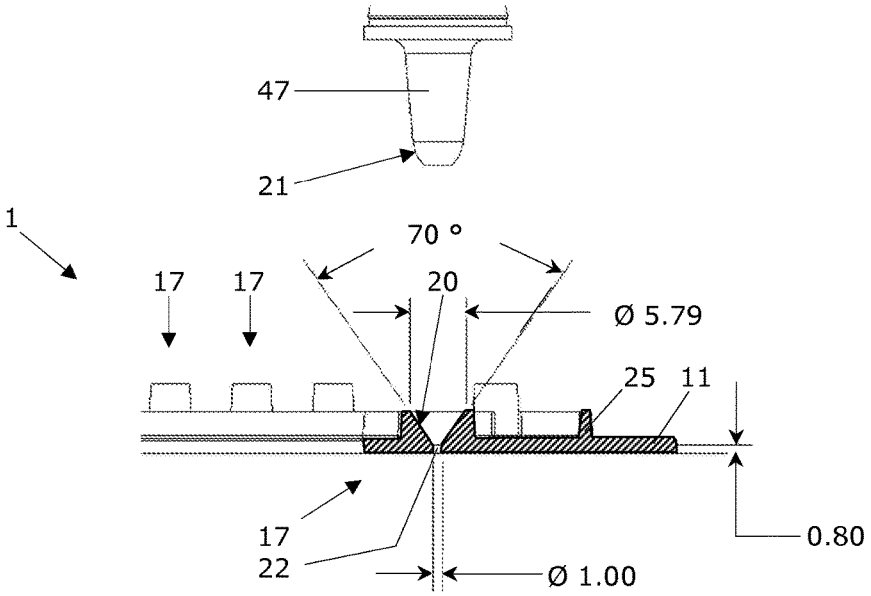
Figure 5:
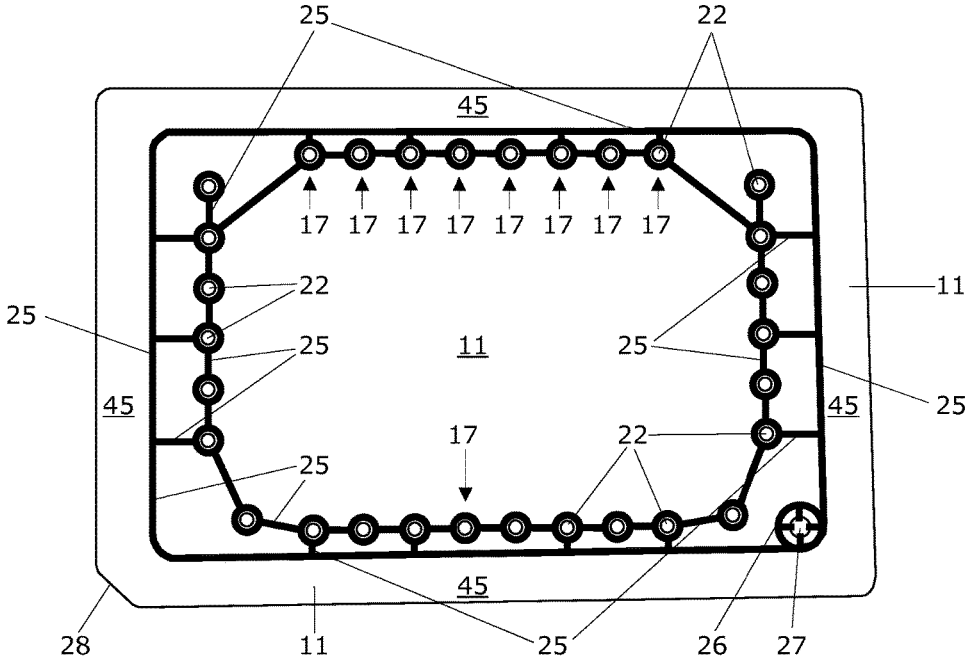
Figure 6:
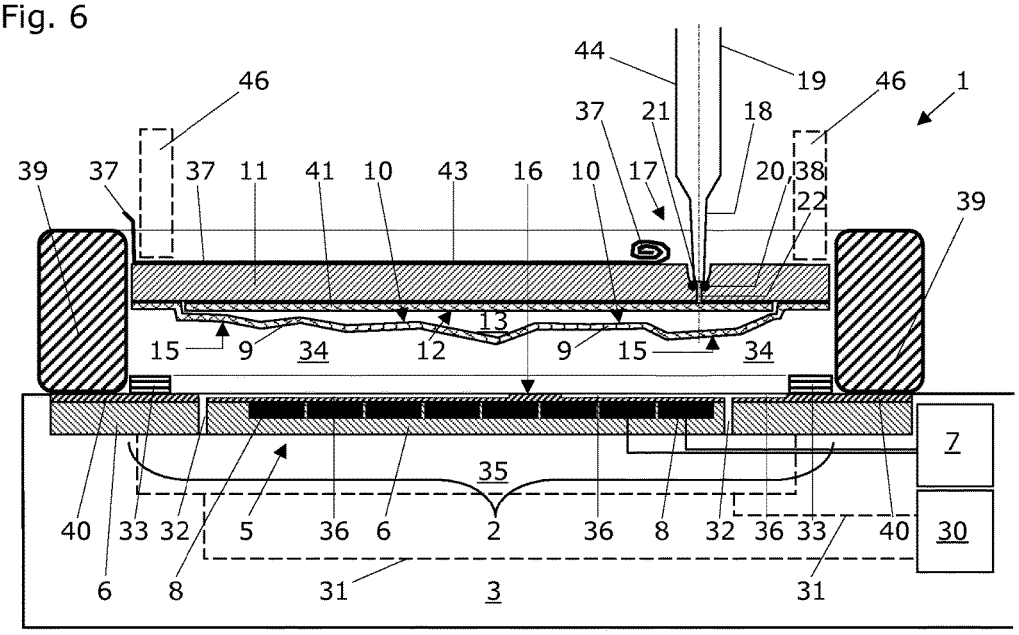

The disposable cartridge with the pipetting guides according to the present invention are described with the help of the attached schematic drawings that show selected and exemplary embodiments of the present invention without narrowing the scope and gist of this invention. It is shown in:

FIG. 1 a cross section of a first embodiment of a pipetting guide configured for essentially perpendicular introduction or withdrawal of a pipette tip;

FIG. 2 a cross section of a second embodiment of a pipetting guide configured for perpendicular or slanted introduction or withdrawal of a pipette tip;

FIG. 3 a cross section of a third embodiment of a pipetting guide configured for slanted introduction or withdrawal of a pipette tip;

FIG. 4 a cross section of a fourth embodiment of a pipetting guide configured for introduction or withdrawal of a dropper;

FIG. 5 a plan view of first variant of a plate-like rigid cover equipped with a large number of pipetting guides according to FIG. 1;

FIG. 6 a cross section of a second variant of a plate-like rigid cover with a single pipetting guide of a fourth embodiment.

DETAILED DESCRIPTION OF THE PRESENT INVENTION

The FIG. 1 shows a cross section of a first embodiment of a pipetting guide 17 configured for essentially perpendicular introduction or withdrawal of a pipette tip 18. In FIG. 1 it is presented a disposable cartridge 1 for use in a digital microfluidics system 3 for manipulating samples in liquid portions or droplets 4, only a small part of the cartridge 1 with a single pipetting guide 17 being visualized though. The digital microfluidics system 3 comprises a cartridge accommodation site 2 and a central control unit 7 for controlling the selection of individual electrodes 8 of an electrode array 5 located at said cartridge accommodation site 2 and for providing a number of said electrodes 8 with individual voltage pulses for manipulating liquid portions or droplets 4 by electrowetting. The disposable cartridge 1 comprises a hydrophobic working surface 10 and a rigid cover 11 with a second hydrophobic surface 12. The hydrophobic surfaces (the hydrophobic working surface 10 and the second hydrophobic surface 12 of the rigid cover 11) are facing each other and are separated or separable in essentially parallel planes by a gap 13 with a gap height 14.

In the scope of the present invention, a "sample" is defined in its broadest sense. A "sample" may be present in or introduced into e.g. an aqueous liquid portion or droplet 4 for example as a biopolymer, e.g. such as nucleic acid or protein; a bio-monomer, e.g. such as nucleic base or amino acid; as ions in buffers; as solvents; and as reagents. These "samples" are listed for illustration only but not for limiting interpretation of the expression "sample".

According to the present invention, the disposable cartridge 1 further comprises a number of pipetting guides 17 (only one being shown here) for safe entering and/or withdrawing liquids into and/or from the gap 13 of the disposable cartridge 1. Such entering or withdrawing preferably is carried out with a tip 18 of a pipette 19. At least one of the pipetting guides 17 is located at a pipetting orifice 22 that reaches through the rigid cover 11. This pipetting guide 17 also is configured to prevent a pipette tip 18 from touching the hydrophobic working surface 10. This pipetting guide 17 further is providing an abutting surface 20 that is sealingly admittable by a counter surface 21 of a pipette tip 18.

In the embodiment depicted in FIG. 1, the digital microfluidics system 3 comprises at a cartridge accommodation site 2 an electrode array 5 supported by a substrate 6 and the disposable cartridge 1 comprises a working film 9 with the hydrophobic working surface 10. This working film 9 of the disposable cartridge 1 comprises a backside 15 that is configured to touch an uppermost surface 16 of a cartridge accommodation site 2 of a digital microfluidics system 3.

In a first variant of the embodiment depicted in FIG. 1, the working film 9 of the disposable cartridge 1 is configured as a flexible sheet that spreads on the uppermost surface 16 of a cartridge accommodation site 2 of the digital microfluidics system 3 which comprises a vacuum source 30 for establishing an underpressure in an evacuation space 34 between the uppermost surface 16 of the cartridge accommodation site 2 and the backside 15 of the working film 9 of the disposable cartridge 1 (see FIG. 6). It is preferred in this first variant that the cartridge accommodation site 2 of the digital microfluidics system 3 or the disposable cartridge 1 comprise a gasket 33 that sealingly encloses said evacuation space 34 and that defines the height 14 of the gap 13 between said hydrophobic surfaces 10,12 of the disposable cartridge 1 (see FIG. 6). It goes without saying that the gasket 33 (which is not visible in FIG. 1) may be attached to the disposable cartridge 1 or to the cartridge accommodation site 2 of the digital microfluidics system 3; moreover providing a rigid gasket 33 as a loose insert is also possible. It is however imperative in this first variant of the embodiment of FIG. 1 that the gasket 33 is outside of the gap 13 and also on the outside of the working film 9. Because of its flexibility, the working film of the disposable cartridge 1 spreads on the uppermost surface 16 of a cartridge accommodation site 2 upon establishing an underpressure in an evacuation space 34 between the uppermost surface 16 of the cartridge accommodation site 2 and the backside 15 of the working film 9 of the disposable cartridge 1. The gasket 33 seals this evacuation space 34 against the environment when an underpressure is established inside the evacuation space 34 using a vacuum source 30 of the digital microfluidics system 3. Flat spreading of the working film 9 provides an essentially uniform height 14 of the gap 13, this gap height 14 being defined by the height of the gasket 33. Preferably the gasket 33 is located close to the outer circumference of the disposable cartridge 1 (see FIG. 6).

In a second variant of the embodiment depicted in FIG. 1, the working film 9 is substantially rigid and the disposable cartridge 1 comprises a spacer 29 that sealingly encloses said gap 13 and that defines the height 14 of the gap 13 between said hydrophobic surfaces 10,12 of the disposable cartridge 1. Preferably the spacer 29 is located close to the outer circumference of the disposable cartridge 1; however, additional and intermediately located spacers 29 may enable the utilization of less rigid and/or thinner working films 9.

In another embodiment (not shown, but known from the prior art, e.g. WO 2008/106678, see there FIGS. 11 and 12) the disposable cartridge 1 comprises an electrode array 5 that is supported by a substrate 6. This electrode array 5 (or a substrate to which this electrode array is attached) comprises the hydrophobic working surface 10. In such an alternative embodiment, the substrate 6 typically comprises a backside 15 that is configured to touch an uppermost surface (or take-up structure) of a cartridge accommodation site 2 of a digital microfluidics system 3.

With respect to both, the first and second variant of the embodiment depicted in FIG. 1 as well as with respect to the alternative embodiment cited, it particularly is preferred that the rigid cover 11 is configured as a plate with the second hydrophobic surface 12 on one side and pipetting guides 17 on an opposite side. Especially preferred is a number of pipetting guides 17 that are configured as ring-like elevations around pipetting orifices 22 and that are located on the side opposite to the second hydrophobic surface 12 of the rigid cover 11 of the disposable cartridge 1.

It may be preferred that at least one of the pipetting guides 17 is configured for essentially perpendicular introduction or withdrawal of a pipette tip 18, in that the pipetting guide 17 comprises a first conical wall that is adapted to the outer surface of a pipette tip 18 and that provides the abutting surface 20 which sealingly is admittable by an outer conical surface of the pipette tip 18 which here acts as the counter surface 21. Such an embodiment of the pipetting guides 17 is directed to an essentially vertical pipetting axis 44 and may comprise that the conical abutting surface 20 reaches through the rigid cover 11 and includes the pipetting orifice 22 (cv. FIG. 1, but not shown).

It may be preferred that at least one of the pipetting guides 17 is configured for essentially perpendicular introduction or withdrawal of a pipette tip 18, in that the pipetting guide 17 comprises a first conical wall with a narrow end at a flat shoulder 23 that provides the abutting surface 20 which sealingly is admittable by a front surface of the pipette tip 18 which here acts as the counter surface 21. Such an embodiment of the pipetting guides 17 is directed to an essentially vertical pipetting axis 44 and preferably combines a conical surface 20 with a cylindrical or conical pipetting orifice 22 (shown in FIG. 1).

The dimensions in FIG. 1 are indicated in mm (millimeters) or in ° (degrees) and generally are marked by slender arrows in contrast to the full arrows which generally belong to reference numbers (see also FIGS. 2-4). These dimensions relate to a first actual embodiment of a pipetting guide 17 that is adapted to a standard disposable pipette tip 18. Such disposable pipette tips 18 may be attached to a handheld or robotic pipette 19. Alternatively, different pipette tips 18 (such as tips 18 of glass pipettes 19) may be applied as well. It is preferred however that the pipetting guide 17 in each case is adapted to the pipette tip 18 utilized. The same rigid cover may comprise one or more types of pipetting guides 17, e.g. depending on the sort and/or volume of the liquid portions 4 (samples, reagents, reactants, buffers, reaction products, etc.) to be introduced into or to be withdrawn from the gap 13 of a disposable cartridge 1. The disposable cartridge of this first actual embodiment preferably is positioned such that the working film 9 is essentially horizontal. Preferred dimensions and materials are also pointed to in table 1. These indications of materials and dimensions serve as preferred examples without limiting the scope of the present invention.

The FIG. 2 shows a cross section of a second embodiment of a pipetting guide 17 configured for perpendicular or slanted introduction or withdrawal of a pipette tip 18. It may be preferred that at least one of the pipetting guides 17 is configured for perpendicular or slanted introduction or withdrawal of a pipette tip 18, in that the pipetting guide 17 comprises a first conical wall with a narrow end at an arcuated shoulder 23 that provides the abutting surface 20 which sealingly is admittable by a front surface of the pipette tip 18 which here acts as the counter surface 21. Such an embodiment of the pipetting guides 17 is directed to an essentially vertical or tilted pipetting axis 44 and preferably combines a conical surface 20 with a cylindrical or conical pipetting orifice 22 (shown in FIG. 2).

It may be preferred that at least one of the pipetting guides 17 is configured for slanted introduction or withdrawal of a pipette tip 18, in that the pipetting guide 17 comprises a first conical wall that is adapted to the outer surface of a pipette tip 18 and that provides the abutting surface 20 which sealingly is admittable by an outer conical surface of the pipette tip 18 which here acts as the counter surface 21. Such an embodiment of the pipetting guides 17 is directed to a strictly tilted pipetting axis 44 and preferably combines a conical surface 20 with a cylindrical or conical pipetting orifice 22 (not shown, but similar to FIG. 1). The conical abutting surface 20 and the pipetting orifice may be coaxial to the tilted pipetting axis or the pipetting orifice 22 may deviate from the pipetting axis 44 and may be essentially vertical.

It may be preferred that at least one of the pipetting guides 17 is configured for slanted introduction or withdrawal of a pipette tip 18, in that the pipetting guide 17 comprises a first conical wall with a narrow end at a flat shoulder 23 that provides the abutting surface 20 which sealingly is admittable by a front surface of the pipette tip 18 which here acts as the counter surface 21. Such an embodiment of the pipetting guides 17 is directed to a strictly tilted pipetting axis 44 and preferably combines a conical surface 20 with a cylindrical or conical pipetting orifice 22 (not shown, but similar to FIG. 1). The conical abutting surface 20 and the pipetting orifice may be coaxial to the tilted pipetting axis or the pipetting orifice 22 may deviate from the pipetting axis 44 and may be essentially vertical.

The dimensions in FIG. 2 are indicated in mm (millimeters) or in ° (degrees) and generally are marked by slender arrows in contrast to the full arrows which generally belong to reference numbers. These dimensions relate to a second actual embodiment of a pipetting guide 17 that is adapted to a standard disposable pipette tip 18. Such disposable pipette tips 18 may be attached to a handheld or robotic pipette 19. Alternatively, different pipette tips 18 (such as tips 18 of glass pipettes 19) may be applied as well. It is preferred however that the pipetting guide 17 in each case is adapted to the pipette tip 18 utilized. The same rigid cover may comprise one or more types of pipetting guides 17, e.g. depending on the sort and/or volume of the liquid portions 4 (samples, reagents, reactants, buffers, reaction products, etc.) to be introduced into or to be withdrawn from the gap 13 of a disposable cartridge 1. The disposable cartridge of this second actual embodiment preferably is positioned such that the working film 9 is horizontal or is tilted with respect to the horizontal direction. Preferred dimensions and materials are also pointed to in table 1. These indications of materials and dimensions serve as preferred examples without limiting the scope of the present invention.

The embodiment of a disposable cartridge 1 shown in FIG. 2 differs from the embodiment in FIG. 1 as follows:

In FIG. 1, the rigid cover 11 of the disposable cartridge 1 directly provides the second hydrophobic surface 12. Preferably, the lower side of the rigid cover 11 is treated to be hydrophobic. Potentially, this lower side of the rigid cover 11 is also treated to be dielectric and it may be envisaged that the rigid cover 11 be composed of a material that is electrically conductive. The electrodes 8 of the electrode array 5 at the cartridge accommodation site 2 here are covered with a dielectric layer that serves as electrical insulation and as protection for the electrodes 8 against mechanical or chemical damages. Such a cartridge accommodation site 2 provides the advantage that the working film 9 of the disposable cartridge 1 may be very thin, flexible, and of a material that needs to be impermeable to liquids and that provides the hydrophobic working surface 10. The gap 13 usually is at least partially filled with a filler fluid 42 that is not miscible with the liquids needed for carrying out the targeted assays, such as samples, buffers, and reagents. Preferably this filler fluid 42 is oil, e.g. silicon oil.

In FIG. 2, the rigid cover 11 of the disposable cartridge 1 comprises a layer of an electrically conductive material 43 on its lower side. Attached to this electrically conductive material 43 or including it is provided a hydrophobic layer 41 that provides the second hydrophobic surface 12. The rigid cover 11 may be from a dielectric material in this case. The rigid cover 11 may comprise a body 24, e.g. for storage of liquids needed for carrying out the targeted assays. As already pointed out, the working film 9 in this case is rather rigid and not flexible as in the FIG. 1. The working film 9 is attached to the rigid cover 11, or to the hydrophobic layer 41, or to the electrically conductive material 43 respectively via a spacer 29 which defines the gap height 14 of the disposable cartridge. The gap 13 usually is at least partially filled with a filler fluid 42 that is not miscible with the liquids needed for carrying out the targeted assays, such as samples, buffers, and reagents. Preferably this filler fluid 42 is oil, e.g. silicon oil.

All pipetting guides 17 with a first conical wall preferably further comprise a second conical wall that is wider than the first conical wall and that serves as additional insertion guide for the pipette tip 18. Some or all pipetting guides 17 may be connected by a reinforcing bar 25 that additionally stabilizes the rigid cover 11 (see FIGS. 1-3).

The pipetting guides 17 of the FIGS. 1 and 2 are particularly suited to allow automatization of pipetting using pipetting robots, while the disposable cartridge is presented horizontally. Accordingly, the pipette tip 18 is presented vertically, i.e. at right angle with respect to the rigid cover 11 and the pipetting axis 44 of the first and second embodiment of a pipetting guide 17 is essentially vertical.

The FIG. 3 shows a cross section of a third embodiment of a pipetting guide 17 configured for slanted introduction or withdrawal of a pipette tip. This third embodiment is a combination of the first and second embodiment and allows automatization of pipetting using pipetting robots, while the disposable cartridge is presented tilted, i.e. at an oblique angle. Accordingly, the pipette tip 18 is presented at an oblique angle with respect to the rigid cover 11. Nevertheless, the pipetting axis 44 of the third embodiment of a pipetting guide 17 preferably is essentially vertical. For automatized pipetting, the tilting angle of the rigid cover 11 with respect to the horizontal preferably is 1° to 15°; in consequence, the angle between the vertical pipetting axis 44 of a pipetting robot and the rigid cover 11 preferably is 75° to 89°. All elements of the disposable cartridge 1 are indicated by the same reference numbers as used in the FIGS. 1 and 2.

The FIG. 4 shows a cross section of a fourth embodiment of a pipetting guide 17 configured for introduction or withdrawal of a dropper 47. The disposable cartridge 1 comprises a rigid cover 11 and at least one pipetting guide 17 that is configured for receiving a dropper 47. The abutting surface 20 of the pipetting guide 17 preferably is a cone with an opening angle of about 70°. The widest diameter of the cone in this exemplary embodiment is 5.79 mm; the diameter of the pipetting orifice 22 is e.g. 1.00 mm and the height of the pipetting orifice here is 0.80 mm. Also shown and indicated are pipetting guides 17 according to the first embodiment that are linked to each other by a reinforcing bar 25 (cv. FIG. 1).

The FIG. 5 shows a plan view of first variant of a plate-like rigid cover 11 equipped with a large number of pipetting guides 17 and pipetting orifices 22 according to FIG. 1. All pipetting guides 17 are linked to each other by a reinforcing bar 25. In addition and as a further means for improving stability of the rigid cover 11, another reinforcing bar 25 surrounds all pipetting guides 17.

Preferably, this surrounding reinforcing bar 25 runs essentially parallel to the border of the rigid cover 11, leaving a free area 45 along the border of the rigid cover 11. It also preferred that the digital microfluidics system 3 comprises a clamping means 46 for establishing good mechanical contact between the rigid cover 11 and the uppermost surface 16 of the cartridge accommodation site 2 (see FIG. 6). It is further preferred that at least a part of the clamping means 46 of the digital microfluidics system 3 is configured to press onto the free area 45 of the rigid cover 11 of a disposable cartridge 1 that properly is placed at the cartridge accommodation site 2 of the digital microfluidics system 3.

Preferably, the rigid cover 11 and thus the entire disposable cartridge 1 have at least approximately the form and size of the footprint of a microplate according to the SBS standard as published by the American National Standards Institute (AN-SI_SBS 1-2-3-4-2004). As such, the rigid cover 11 and thus the entire disposable cartridge 1 comprise an orientation edge 28 for definite positioning of a disposable cartridge 1 at a cartridge accommodation site 2 of a digital microfluidics system 3.

Preferably, the rigid cover 11 further comprises at least one oil loading port 26 with at least one oil loading orifice 27 through which oil is introducible into the gap 13 of the disposable cartridge 1. It is especially preferred that the oil loading port 26 is configured for the sealing attachment of a syringe. Such sealing attachment may be provided according to a Luer lock or Luer slip. Alternatively, a dropper 47 of a commercial dropper bottle, e.g. of a glass dropper bottle for essential oils may be utilized e.g. for loading oil 42 into the gap 13 of a disposable cartridge 1 of the present invention. Similarly as adapting the pipetting guide 17 to the type of pipette 19 or pipette tip 18 intended for entering and/or withdrawing liquids into and/or from the gap 13 of the disposable cartridge 1, the oil loading port 26 is adapted to the means for loading oil 42, such as e.g. a Luer lock or Luer slip system or a dropper 47. Such a dropper 47 may also be used for introducing buffers and other liquids without particular need for volume precision.

The FIG. 6 shows a cross section of a second variant of a plate-like rigid cover 11 with a single pipetting guide 17 of a third embodiment. The disposable cartridge 1 is depicted before reaching its final and defined location at the cartridge accommodation site 2 of the digital microfluidics system 3. Preferably and as already pointed to, the disposable cartridge 1 is configured to be hold in place at the cartridge accommodation site 2 with a clamping means 46.

The depicted disposable cartridge 1 comprises a minimized number of elements in order to simplify the production costs for the disposable cartridge 1. The disposable cartridge 1 of this fourth embodiment preferably comprises:

a) a plane rigid cover 11 with a lower surface and a hydrophobic layer 41 attached to the lower surface, the hydrophobic layer 41 providing the second hydrophobic surface 12 and preferably being at least permeable to ions;

b) a working film 9 with the hydrophobic working surface 10, the working film 9 being impermeable to liquids and being configured for manipulating samples in liquid droplets 4 thereon utilizing an electrode array 5 of the digital microfluidics system 3 when the working film 9 of the disposable cartridge 1 is placed over said electrode array 5 and onto the uppermost surface 16 of the cartridge accommodation site 2 of the digital microfluidics system 3; and c) a gap 13 that is located between the hydrophobic working surface 10 of the working film 9 and the second hydrophobic surface 12 of the rigid cover 11.

Preferably, the working film 9 is a flexible film that is sealingly attached to the rigid cover 11 along a circumference of the flexible working film 9. This flexible working film 9 is configured to be attracted and spread over the uppermost surface 16 of a cartridge accommodation site 2 of the digital microfluidics system 3 by the underpressure in the evacuation space 34. As soon as the disposable cartridge 1 correctly is placed at the cartridge accommodation site 2, the evacuation space 34 is defined by the uppermost surface 16 of the cartridge accommodation site 2, the backside 15 of the working film 9 and by the gasket 33. In the variant depicted, the gasket 33 is attached to the uppermost surface 16 of the cartridge accommodation site 2 of the digital microfluidics system 3. Because of the rigidity of the rigid cover 11 and because of the attraction of the working film 9 to the uppermost surface of the cartridge accommodation site 2, a gap 13 with a defined gap height 14 is established by the underpressure in the evacuation space 34. Here, the gap height 14 is essentially equal to the height of the gasket 33. The disposable cartridge 1 thus is devoid of a spacer 29 that would need to be located inside the gap 13 between a working film 9 and a second hydrophobic surface 12 of the rigid cover 11 (see FIG. 2).

In the depicted embodiment of FIG. 6, to the lower surface of the rigid cover 11 a hydrophobic layer 41 that provides the second hydrophobic surface 12 is attached. It may be preferred that the disposable cartridge 1 comprises an electrically conductive material 43 that is directly attached to the lower surface the rigid cover 11 or that the rigid cover itself is made electrically conductive.

The embodiment of the cartridge accommodation site 2 of the digital microfluidics system 3 in the FIG. 6 comprises a number of suction orifices 32, which are located at the cartridge accommodation site 2 of the digital microfluidics system 3. These suction orifices 32 simply penetrate the electrode array 5 and/or the bottom substrate 6 that carries the electrode array 5. A number of vacuum lines 31 directly lead to these suction orifices 32 and that link these suction orifices 32 to the vacuum source 30 of the digital microfluidics system 3. In order to practically evenly distribute the underpressure within the evacuation space 34, the suction orifices 32 preferably are practically evenly distributed over the area of the electrode array 5 and cartridge accommodation site 2 (not shown). In the depicted embodiment, the digital microfluidics system 3 comprises a number of suction orifices 32 that penetrate the bottom substrate 6, but not the electrode array 5. These suction orifices 32 are preferably distributed in the cartridge accommodation site 2 around the area of the electrode array 5. In order to practically evenly distribute the underpressure within the evacuation space 34, the suction orifices 32 are configured to mouth into suction channels 36. These suction channels 36 are arranged in the uppermost surface 16 of the cartridge accommodation site 2 of the digital microfluidics system 3.

In the embodiment shown in the FIG. 6, the uppermost surface 16 of the cartridge accommodation site 2 is provided by the dielectric layer 40 that covers the individual electrodes 8 and that is attached to the upper surface of the electrode array 9 and the bottom substrate 11. In consequence, the suction channels 36 are configured as grooves that are countersunk in the surface of the dielectric layer 40. The pattern of these suction channels 36 or grooves may comprise branched or un-branched straight lines, branched or un-branched meandering lines and any combinations thereof. As shown, the suction channels 36 or grooves may reach over a part of the electrode array 5 and/or over a part of the bottom substrate 6. Deviating from the straight suction orifices 32 as shown in the FIG. 6, the suction orifices 32 can penetrate the bottom substrate 6 in any arbitrary direction as best suited, e.g. the suction orifices 32 can be configured to penetrate the bottom substrate 6 at an oblique angle or stepwise. Especially in a case where the bottom substrate 6 is configured to comprise two separate plates that are sandwiched on top of each other (not shown), stepwise and/or branched configuration of the suction orifices 32 may be preferred in order to reduce complexity of the suction channels 36 or grooves in the surface of the dielectric layer 40.

In any case, it is preferred to arrange the suction channels 36 or grooves such that an even underpressure can be established in the evacuation space 34. As soon as the disposable cartridge 1 is located at the cartridge accommodation site 2, the gasket 33 seals in the cartridge accommodation site 2 the evacuation space 34, which is defined by the flexible working film 9 of the disposable cartridge 1, the uppermost surface 16 of the cartridge accommodation site 2, and the gasket 33.

The suction orifices 32 can be directly linked to the vacuum source 30 of the digital microfluidics system 3 by an appropriate number of vacuum lines 31 (not shown). Alternatively, the suction orifices 32 may be configured to mouth into a vacuum space 35, which vacuum space 35 is arranged at the at least one cartridge accommodation site 2 and under the electrode array 5 and/or the bottom substrate 6. Preferably, the vacuum space 35 is connected to the vacuum source 30 of the digital microfluidics system 3 by at least one vacuum line 31 (see FIG. 6).

In all embodiments shown or described, the flexible working film 9 preferably is configured as a monolayer or single layer, respectively of a hydrophobic material.

Alternatively, the flexible working film 9 is configured as a monolayer or single layer, respectively of electrically non-conductive material, an upper surface of the flexible working film 9 being treated to be a hydrophobic working surface 10. According to a preferred alternative variant, the flexible working film 9 is configured as a laminate comprising a lower layer and a hydrophobic upper layer, the lower layer being electrically conductive or non-conductive.

The gasket 33 may be attached to the bottom substrate 6 (not shown) or to the dielectric layer 40 (shown). In the FIG. 6, the dielectric layer 40 is attached to the surface of the electrode array 5, protecting the individual electrodes 8 from oxidation, mechanical impact and other influences like contamination. Alternative to the FIG. 6, the dielectric layer 40 may also cover the gasket 33 that is configured as a closed ring that extends around the accommodation site 2 for the disposable cartridge 1. The dielectric layer 40 may further cover at least a part of an insertion guide 39 and may reach over a part or beyond the entire height of the disposable cartridge 1 (not shown).

In another alternative embodiment, the disposable cartridge 1 comprises the gasket 33 that is attached to a lower surface and along the circumference of the flexible working film 9. The gasket 33 thus defines a particular distance between said hydrophobic working surface 10 and said second hydrophobic surface 12, when the disposable cartridge 1 is placed over the electrode array 5 of the digital microfluidics system 3 which is equipped with suction orifices 32 such that the flexible working film 9 is aspirated by said suction orifices 32 and spread over the uppermost surface 16 of the cartridge accommodation site 2.

The disposable cartridge 1 in FIG. 6 comprises a rigid cover 11 which is configured as a plate and which comprises the second hydrophobic surface 12 on one side and pipetting guides 17 on an opposite side. Here, only one pipetting guide 17 is shown to represent the smallest number of pipetting guides 17 that are configured as circular depressions around pipetting orifices 22 and that are located on the side opposite to the second hydrophobic surface 12 of the rigid cover 11 of the disposable cartridge 1. In this embodiment it is preferred that at least one of the pipetting guides 17 is configured for essentially perpendicular introduction or withdrawal of a pipette tip 18, in that the pipetting guide 17 comprises a shoulder 23 with a seal 38 that provides the abutting surface 20 which sealingly is admittable by a front surface of the pipette tip 18 which here acts as the counter surface 21. Preferably, such seals 38 are configured as an O-ring and are made of Neoprene® ore Viton® (both by DuPont, Wilmington, US).

The disposable cartridge 1 of the present invention which comprises the particular pipetting guide 17 enables for carrying the following methods of (A) introducing a liquid portion 4 into the gap 13 or respectively for (B) withdrawing a liquid portion 4 from the gap 13 of a disposable cartridge 1 for use in a digital microfluidics system 3 for manipulating samples in liquid portions or droplets 4.

For carrying out the method (A) or (B), the digital microfluidics system 3 comprises a cartridge accommodation site 2 and a central control unit 7 for controlling the selection of individual electrodes 8 of an electrode array 5 located at said cartridge accommodation site 2 and for providing a number of said electrodes 8 with individual voltage pulses for manipulating liquid portions or droplets 4 by electrowetting. The disposable cartridge 1 comprises a hydrophobic working surface 10 and a rigid cover 11 with a second hydrophobic surface 12, said hydrophobic surfaces 10,12 facing each other and being separated or being separable in essentially parallel planes by a gap 13 with a gap height 14.

The method (A) comprises the steps of:

(a) placing a disposable cartridge 1 at a cartridge accommodation site 2 of a digital microfluidics system 3;

(b) providing a an essentially uniform height 14 of the gap 13 between said hydrophobic surfaces 10,12 of the disposable cartridge 1;

(c) aspirating a volume of a liquid into a tip 18 of a pipette 19;

(d) inserting the pipette tip 18 into a pipetting guide 17 of the disposable cartridge 1, said pipetting guide 17 being located at a pipetting orifice 22 which reaches through the rigid cover 11;

(e) sealingly touching an abutting surface 20 of the pipetting guide 17 with a counter surface 21 of the pipette tip 18; and (f) dispensing a liquid portion 4 through the pipetting orifice 22 of the rigid cover 11 into the gap 13 of the disposable cartridge 1.

The method (B) comprises the steps of:

(m) inserting a tip 18 of a pipette 19 into a pipetting guide 17 of the disposable cartridge 1, said pipetting guide 17 being located at a pipetting orifice 22 that reaches through the rigid cover 11;

(n) sealingly touching an abutting surface 20 of the pipetting guide 17 with a counter surface 21 of the pipette tip 18;

(o) aspirating a liquid portion 4 from the gap 13 of the disposable cartridge 1 into the pipette tip 18; and (p) withdrawing the pipette tip 18 with the liquid portion 4 from the pipetting guide 17 of the disposable cartridge 1.

In a first embodiment of the method (A) or (B) according to the present invention it is preferred that the disposable cartridge 1 comprises an electrode array 5 supported by a substrate 6, said electrode array 5 comprising the hydrophobic working surface 10. In this first embodiment it is further preferred that said substrate 6 comprises a backside 15 that is touching an uppermost surface 16 of a cartridge accommodation site 2 of a digital microfluidics system 3 when said disposable cartridge 1 is placed at said cartridge accommodation site 2 of the digital microfluidics system 3.

In a second embodiment of the method (A) or (B) according to the present invention it is preferred that the digital microfluidics system 3 comprises at a cartridge accommodation site 2 an electrode array 5 supported by a substrate 6. In this second embodiment it is further preferred that the disposable cartridge 1 comprises a working film 9 with the hydrophobic working surface 10, said working film 9 comprising a backside 15 that is touching an uppermost surface 16 of a cartridge accommodation site 2 of a digital microfluidics system 3.

In the second embodiment of the method (A) or (B) it may be additionally preferred that the working film 9 of the disposable cartridge 1 is configured as a flexible sheet and spreads on the uppermost surface 16 of a cartridge accommodation site 2 upon establishing an underpressure in an evacuation space 34 between the uppermost surface 16 of the cartridge accommodation site 2 and the backside 15 of the working film 9 of the disposable cartridge 1 using a vacuum source 30 of the digital microfluidics system 3 for providing a an essentially uniform height 14 of the gap 13.

In the second embodiment of the method (A) or (B) it may be additionally preferred that the disposable cartridge 1 comprises a spacer 29 that sealingly encloses said gap 13 and that defines the height 14 of the gap 13 between said hydrophobic surfaces 10,12 of the disposable cartridge 1. This method comprises the steps of:

(i) providing a substantially rigid working film 9; and (ii) defining an essentially uniform height 14 of the gap 13 between said hydrophobic working surface 10 of the rigid working film 9 and said second hydrophobic surface 12 of the rigid cover 11 with the spacer 29 to which the rigid cover 11 and rigid working film 9 are firmly attached.

It is preferred that there is no direct and full electrical contact between the liquid portions or droplets 4 in the gap 13 of the disposable cartridge 1 and the individual electrodes 8 set to an activation potential nor to an electrical conductive material 43 set to ground potential.

The disposable cartridge 1 may comprise a peel-off protection film 37 that covers sensible parts, such as pipetting guides 17 and pipetting orifices 22.

Any combination of the features of the different embodiments of the disposable cartridge 1 disclosed herein that appear reasonable to a person of skill are comprised by the gist and scope of the present invention.

Even if they are not particularly described in each case, the reference numbers refer to similar elements of the digital microfluidics system 3 and in particular of the disposable cartridge 1 of the present invention.

The following materials and dimensions are especially preferred for manufacturing a disposable cartridge 1 for use in a digital microfluidics system 3 according to the the present invention:

Cytop is an amorphous fluoropolymer with high optical transparency (AGC Chemicals Europe). Mylar®, Neoprene®, Teflon®, and Viton® are Trademarks of DuPont, Wilmington, USA.

TABLE 1

| Part | No | Material | Dimensions and Shape |
|---|---|---|---|
| Liquid portion or droplet | 4 | aqueous | Volume: 0.1-5 μl |
| Substrate | 6 | PCB; Synth. Polymer | — |
| Electrodes | 8 | Al; Cu; Au; Pt | Plating: 1.5 × 1.5 mm |
| Working film | 9 | Fluorinated ethylene propylene (FEP), Cyclo olefin polymer (COP), Polypropylene (PP) | Foil: 8-50 μm |
| $1^{st}$ hydrophobic surface | 10 | COP, FEP, PP | Foil: 8-50 μm |
| Rigid cover | 11 | Mylar ®; acrylic; Polypropylene (PP) | Plate: 0.5-10.0 mm; preferably 1.5 mm |
| $2^{nd}$ hydrophobic surface | 12 | Teflon ® (PTFE) | Spin coating: 5-500 nm; preferably 20 nm |
| Gap height | 14 | — | 0.2-2.0 mm; preferably 0.5 mm |
| Pipetting orifice | 22 | — | Diameter: 0.3-3.0 mm |
| Body | 24 | Mylar ®; acrylic; Polypropylene (PP) | 65 × 85 mm; 6-25 mm |
| Spacer | 29 | Polypropylene (PP) | Frame: 0.2-2.0 mm; preferably 0.5 mm |
| Gasket | 33 | Synthetic or natural rubber | Frame: 0.2-2.0 mm; preferably 0.5 mm |
| Peel off protection film | 37 | Polyethylene terephthalate (PET) liner; PP; silicone | 70 × 110 mm; 0.1 mm |
| Seal | 38 | Viton ®; Neoprene ® | O-ring Ø 3.0 mm |
| Insertion guide | 39 | Al; Al/Mg; steel; Teflon ® (PTFE) | Frame: 5-30 mm |
| Dielectric layer | 40 | Fluorinated ethylene propylene (FEP) | Foil or casting: 20-100 μm |
| Hydrophobic layer | 41 | FEP; PTFE; Cytop | 2-200 nm |
| Oil | 42 | Silicon | Volume: 1-5 ml |
| Electrically conductive material | 43 | Au, Pt, ITO, PP, PA | Layer: 20-100 μm; preferably 50 μm |

| Reference numbers | |
|---|---|
| 1 | disposable cartridge |
| 2 | cartridge accommodation site |
| 3 | digital microfluidics system |
| 4 | liquid portion or droplet |
| 5 | electrode array |
| 6 | substrate, bottom substrate |

-continued

| Reference numbers | |
|---|---|
| 7 | central control unit |
| 8 | individual electrodes of 5 |
| 9 | working film |
| 10 | hydrophobic working surface |
| 11 | rigid cover |
| 12 | second hydrophobic surface of 11 |
| 13 | gap |
| 14 | gap height |
| 15 | backside of 9 |
| 16 | uppermost surface of 2 |
| 17 | pipetting guide |
| 18 | tip of a pipette, pipette tip |
| 19 | pipette |
| 20 | abutting surface of 17 |
| 21 | counter surface of 18 |
| 22 | pipetting orifice of 11, 17 |
| 23 | shoulder of 17 |
| 24 | body of 11 |
| 25 | reinforcing bar of 11 |
| 26 | oil loading port of 11 |
| 27 | oil loading orifice of 11, 26 |
| 28 | orientation edge of 11 |
| 29 | spacer |
| 30 | vacuum source |
| 31 | vacuum line |
| 32 | suction orifice |
| 33 | gasket |
| 34 | evacuation space |
| 35 | vacuum space |
| 36 | suction channels |
| 37 | peel-off protection film |
| 38 | seal |
| 39 | insertion guide |
| 40 | dielectric layer |
| 41 | hydrophobic layer |
| 42 | filler fluid, oil |
| 43 | electrically conductive material |
| 44 | pipetting axis |
| 45 | free area of 11 |
| 46 | clamping means of 3 |
| 47 | dropper |

What is claimed is:

1. A disposable cartridge (1) for use in a digital microfluidics system (3) for manipulating samples in liquid portions or droplets (4); the digital microfluidics system (3) comprising a cartridge accommodation site (2) and a central control unit (7) for controlling the selection of individual electrodes (8) of an electrode array (5) located at said cartridge accommodation site (2) and for providing a number of said electrodes (8) with individual voltage pulses for manipulating liquid portions or droplets (4) by electrowetting; the disposable cartridge (1) comprising a hydrophobic working surface (10) and a rigid cover (11) with a second hydrophobic surface (12); said hydrophobic surfaces (10,12) facing each other and being separated or being separable in essentially parallel planes by a gap (13) with a gap height (14):

wherein the disposable cartridge (1) further comprises a number of pipetting guides (17) for safe entering and/or withdrawing liquids into and/or from the gap (13) of the disposable cartridge (1) with a tip (18) of a pipette (19); at least one of the pipetting guides (17):

being located at a pipetting orifice (22) that reaches through the rigid cover (11), and being configured to prevent a pipette tip (18) from touching the hydrophobic working surface (10), and providing an abutting surface (20) that is sealingly admittable by a counter surface (21) of a pipette tip (18), wherein the pipetting guide comprises a shoulder and a first conical wall with a narrow end at the shoulder that provides the abutting surface.

2. The disposable cartridge (1) of claim 1, wherein the disposable cartridge (1) comprises an electrode array (5) supported by a substrate (6), said electrode array (5) comprising the hydrophobic working surface (10);

and wherein said substrate (6) comprises a backside (15) that is configured to touch an uppermost surface (16) of said cartridge accommodation site (2) of the digital microfluidics system (3).

3. The disposable cartridge (1) of claim 1, wherein the digital microfluidics system (3) comprises at said cartridge accommodation site (2) an electrode array (5) supported by a substrate (6);

and wherein the disposable cartridge (1) comprises a working film (9) with the hydrophobic working surface (10), said working film (9) comprising a backside (15) that is configured to touch an uppermost surface (16) of said cartridge accommodation site (2) of the digital microfluidics system (3).

4. The disposable cartridge (1) of claim 3, wherein the working film (9) of the disposable cartridge (1) is configured as a flexible sheet that spreads on the uppermost surface (16) of said cartridge accommodation site (2) of the digital microfluidics system (3) which comprises a vacuum source (30) for establishing an underpressure in an evacuation space (34) between the uppermost surface (16) of the cartridge accommodation site (2) and the backside (15) of the working film (9) of the disposable cartridge (1).

5. The disposable cartridge (1) of claim 4, wherein the cartridge accommodation site (2) of the digital microfluidics system (3) or the disposable cartridge (1) comprise a gasket (33) that sealingly encloses said evacuation space (34) and that defines the height (14) of the gap (13) between said hydrophobic surfaces (10,12) of the disposable cartridge (1).

6. The disposable cartridge (1) of claim 3, wherein the rigid cover (11) is configured as a plate with the second hydrophobic surface (12) on one side and said pipetting guides (17) on an opposite side, a number of pipetting guides (17) being configured as ring-like elevations around pipetting orifices (22) and on the side opposite to the second hydrophobic surface (12) of the rigid cover (11) of the disposable cartridge (1).

7. The disposable cartridge (1) of claim 6, wherein, the at least one of the pipetting guides (17) is configured for perpendicular or slanted introduction or withdrawal of a pipette tip (18), in that the pipetting guide (17) comprises a first conical wall with a narrow end at an arcuated shoulder (23) that provides the abutting surface (20) which sealingly is admittable by a counter surface of the pipette tip (18).

8. The disposable cartridge (1) of claim 6, wherein at least one of the pipetting guides (17) is configured for slanted introduction or withdrawal of a pipette tip (18), in that the pipetting guide (17) comprises a first conical wall that is adapted to the outer surface of a pipette tip (18) and that provides the abutting surface (20) which sealingly is admittable by an outer conical surface of the pipette tip (18).

9. The disposable cartridge (1) of claim 6, wherein a number of pipetting guides (17) further comprises a second conical wall that is wider than the first conical wall and that serves as additional insertion guide for the pipette tip (18).

10. The disposable cartridge (1) of claim 3, wherein a number of pipetting guides (17) is rigidly connected with each other by reinforcing bars (25) that are of the same material as the rigid cover (11) and the pipetting guides (17), the rigid cover (11) with pipetting guides (17) and reinforcing bars (25) being manufactured by injection molding.

11. The disposable cartridge (1) of claim 3, wherein the rigid cover (11) further comprises at least one oil loading port (26) with at least one oil loading orifice (27) through which oil is introducible into the gap (13) of the disposable cartridge (1), the oil loading port (26) being configured for sealing attachment of a syringe.

12. The disposable cartridge (1) of claim 1, wherein the abutting surface is one of: flat, conical and arcuated.

13. The disposable cartridge (1) of claim 1, wherein the pipetting guide is directed to an essentially vertical or a tilted pipetting axis.

14. The disposable cartridge (1) of claim 1, wherein the pipetting guide combines the abutting surface with a cylindrical or conical pipetting orifice.

* * * * *